United States Patent [19]

Brinkley

[11] Patent Number: 4,560,487

[45] Date of Patent: Dec. 24, 1985

[54] BLENDS OF FLUOROCHEMICALS AND FIBROUS SUBSTRATES TREATED THEREWITH

[75] Inventor: Robert W. Brinkley, Mahtomedi, Minn.

[73] Assignee: Minnesota Mining and Manufacturing Company, St. Paul, Minn.

[21] Appl. No.: 640,958

[22] Filed: Aug. 15, 1984

Related U.S. Application Data

[63] Continuation-in-part of Ser. No. 451,497, Dec. 20, 1982, abandoned, which is a continuation-in-part of Ser. No. 440,325, Nov. 9, 1982, abandoned.

[51] Int. Cl.[4] ..... D06M 13/08

[52] U.S. Cl. ..... 252/8.75; 252/8.8; 252/8.9

[58] Field of Search ..... 252/8.8, 8.9, 8.75

[56] References Cited

U.S. PATENT DOCUMENTS

| | | | |
|---|---|---|---|
| 3,329,661 | 7/1967 | Smith et al. | 260/793 |
| 3,458,571 | 7/1968 | Tokoli | 260/556 |
| 3,462,296 | 4/1969 | Raynolds et al. | 117/161 |
| 3,484,281 | 12/1969 | Guenthner et al. | 117/121 |
| 3,574,791 | 4/1971 | Sherman et al. | 260/884 |
| 3,728,151 | 4/1973 | Sherman et al. | 117/138.8 |
| 3,787,351 | 1/1974 | Olson | 260/40 |
| 3,896,251 | 7/1975 | Landucci | 428/290 |
| 3,916,053 | 10/1975 | Sherman et al. | 428/96 |
| 3,923,715 | 12/1975 | Dettre et al. | 260/29.6 |
| 4,013,627 | 3/1977 | Temple | 526/245 |
| 4,024,178 | 5/1977 | Landucci | 260/472 |
| 4,029,585 | 6/1977 | Dettre et al. | 252/8.6 |
| 4,144,367 | 3/1979 | Landucci | 428/96 |
| 4,165,338 | 8/1979 | Katsuchima et al. | 260/584 |
| 4,174,433 | 11/1979 | Schafer et al. | 528/49 |
| 4,190,545 | 2/1980 | Marshall et al. | 252/8.75 |
| 4,215,205 | 7/1980 | Landucci | 525/8.75 |
| 4,264,484 | 4/1981 | Patel | 260/29.6 |
| 4,289,892 | 9/1981 | Soch | 560/26 |
| 4,325,857 | 4/1982 | Champaneria et al. | 523/412 |
| 4,340,749 | 7/1982 | Patel | 560/182 |

OTHER PUBLICATIONS

"Preparation Methods of Polymer Chemistry," Sorenson and Campbell, 2nd ed., Interscience Publishers, (1968).

Banks, R. E., Ed., "Organofluorine Chemicals and Their Industrial Applications", Ellis Horwood, Ltd., West Sussex, England, 226–230 (1979).

Kirk-Othmer, *Encyclopedia of Polymer Science and Technology*, 8, 374–404, (1968).

*Primary Examiner*—Prince E. Willis
*Assistant Examiner*—Willie J. Thompson
*Attorney, Agent, or Firm*—Donald M. Sell; James A. Smith; Carole Truesdale

[57] ABSTRACT

Blends of fluoroaliphatic radical-containing compounds and fluoroaliphatic radical-containing poly(oxyalkylenes) useful in the form of organic solutions or aqueous dispersions in the treatment of fibrous substrates, such as textile fibers, to impart oil and water repellency.

17 Claims, No Drawings

BLENDS OF FLUOROCHEMICALS AND FIBROUS SUBSTRATES TREATED THEREWITH

This application is a continuation-in-part of copending application Ser. No. 451,497 filed Dec. 20, 1982, which is a continuation-in-part of application Ser. No. 440,325, filed Nov. 9, 1982, both now abandoned.

This invention relates to the treatment of fibrous substrates, such as textile fibers, paper, and leather, with fluorochemical compositions to impart oil and water repellency, and to the resulting treated substrates. In another aspect, it relates to the treatment of carpet fiber with a finish comprising a fluoroaliphatic radical-containing composition to impart oil and water repellency and soil resistance to such fiber. In another aspect, it relates to fluoroaliphatic radical-containing compositions, and their preparation, which are useful in such treatment.

In the industrial production of textiles, such as carpet and apparel, and such other fibrous substrates as paper and leather, it is common to treat such substrates with fluorochemicals containing fluoroaliphatic radicals (often designated by the symbol "$R_f$") to impart oil and water repellency to the surface of such substrates. Fluorochemicals of this type and their application to fibrous substrates are described in various prior art publications, e.g., U.S. Pat. Nos. 3,329,661 (Smith et al), 3,458,571 (Tokoli), 3,574,791 (Sherman et al), 3,728,151 (Sherman et al), 3,916,053 (Sherman et al), 4,144,367 (Landucci), 3,896,251 (Landucci), 4,024,178 (Landucci), 4,165,338 (Katsushima et al), 4,190,545 (Marshall), 4,215,205 (Landucci), 4,013,627 (Temple), 4,264,484 (Patel), 4,029,585 (Dettre), 3,462,296 (Raynolds et al), and 4,325,857 (Champaneria et al), and Banks, R. E., Ed. "Organofluorine Chemicals and their Industrial Applications", Ellis Horwood, Ltd., West Sussex, England, 226–230 (1979).

Although some fluorochemicals are useful in many applications and many are commercial products, some are relatively expensive to prepare and apply, others are difficult to apply, and others are not durable or do not impart the required properties to the extent desired.

Conventionally, fluorochemical compositions have been commercially applied as a top coating to the finished fibrous article, such as carpet. Recently, several fluorochemical compositions have been commercially applied to textile fiber or yarn during its manufacture before it is woven or fabricated into the finished article. However, some of these fluorochemical compositions have had limited success for various reasons including incompatibility or reactivity of the fluorochemical with fiber finish components such as lubricants, lack of durability of the fluorochemical on the treated fiber to dyeing or other fiber manufacturing operations, and insufficient water and oil repellency and soil resistance in the finished article.

It is an object of this invention to provide blends of (a) fluoroaliphatic radical-containing compounds which impart oil and water repellency, such as fluoro-aliphatic radical-containing carbodiimide (hereinafter often called fluorochemical carbodiimides for brevity), or fluoroaliphatic radical-containing esters (hereinafter called fluorochemical esters), or fluoroaliphatic radical-containing carbonylimino compounds (hereinafter often called fluorochemical carbonylimino compounds for brevity), and (b) fluoroaliphatic radical-containing poly(oxyalkylenes) (hereinafter often called fluorochemical oxyalkylenes for brevity), said blends being useful for treating textile fibers and other fibrous substrates to impart oil and water repellency thereto.

Another object of this invention is to provide blends of fluorochemical carbodiimide, carbonylimino, or ester compounds and fluorochemical oxyalkylenes, which blends can be used to treat textile fibers in combination with or as a component of fiber finishes, e.g. spin-finish lubricants, such blends being compatible with said fiber finishes and not interfering with normal textile fiber processing steps.

A further object of this invention is to provide fluorochemical-treated textile fiber with a high percentage of the fluorochemical retained on the fiber through fiber processing and dyeing steps, and with durable water and oil repellency and soil resistance properties.

It is yet another object of this invention to provide blends of fluorochemical carbodiimide, carbonylimino, or ester compounds and flurochemical oxyalkylenes which can be used in the form of organic solutions or aqueous dispersions to treat fibrous substrates such as textile fibers, filaments, yarns, or finished fibrous articles, e.g. carpets, and other fibrous substrates such as paper and leather, to impart oil and water repellency thereto.

Briefly, this invention provides, in one aspect, compositions comprising blends of: (a) normally solid, water-insoluble, fluorochemical compositions which impart oil and water repellency to fibrous substrates and are fluoroaliphatic radical-containing compounds such as carbodiimide, carbonylimino, or ester compounds, or compositions comprising or consisting essentially of mixtures of said compounds, which compounds have one or more monovalent fluoroaliphatic radicals ($R_f$) and one or more polar moieties such as carbodiimido, carbonylimino, and/or ester moieties, such radicals and moieties bonded together by hetero atom-containing or organic linking groups; and (b) normally liquid or low melting solid, water soluble or dispersible, fluoroaliphatic radical-containing poly(oxyalkylenes), or compositions comprising or consisting essentially of mixtures of said oxyalkylenes, which poly(oxyalkylenes) have one or more monovalent fluoroaliphatic radical ($R_f$) and one or more poly(oxyalkylene) moieties, such radicals and oxyalkylene moieties bonded together by hetero atom-containing groups or organic linking groups, or combinations or such groups. Said fluorochemical blends of components (a) and (b), some of which blends are novel per se (viz., where the polar moiety is a N-containing polar moiety) are useful in the form of organic solutions or aqueous dispersions in the treatment of fibrous substrates, such as textile fibers (or filaments) during their manufacture, and useful also in the treatment of finished or fabricated fibrous substrates such as carpets, paper, and leather, to impart oil and water repellency to the surface thereof.

A class of such fluorochemical carbodiimides (component (a) of said blends) can be represented by the general formula $$R^1-Q-_x-N=C=N-A-_nN=C=N-Q-_xR^1 \qquad \text{I}$$

which formula generically encompasses individual compounds or represents a mixture of such compounds as they are obtained from reactions used in their preparation.

Fluorochemical carbodiimides useful in this invention and their preparation are described in U.S. Pat. No.

4,024,178 (Landucci), which description is incorporated herein by reference thereto.

In formula I, "n" is a number (in the case where the formula is that of a mixture) or an integer (in the case where the formula is that of a compound) of 0 up to 20, preferably 0 to 10 and most preferably 0 to 5, and "x" is 0 or 1. Each Q is the same or different divalent linking group. A is a divalent organic linking group which can contain a fluoroaliphatic radical, $R_f$, each A being the same or different. Each $R^1$ is the same or different and is selected from H, $R_f$, and terminal monovalent organic radicals such as alkyl, cycloalkyl, aryl, and combinations thereof, e.g. aralkyl, which radicals can contain hetero moieties, e.g.

$$-O-,\ -S-,\ -\overset{|}{N}-,\ -\underset{|}{\overset{|}{Si}}-,$$

and —CO—, and is preferably free of active (or isocyanate-reactive) hydrogen atoms (i.e., hydrogen atoms or groups, such as mercapto, amino, carboxyl, and aliphatic hydroxyl groups, that can react readily with isocyanate under urethane bond-forming conditions, e.g., 20° to 100° C.). Generally, $R^1$ will have no more than about 18 carbon atoms. Where $R^1$ is said $R_f$, the subscript x of the adjacent Q must be 1 and not 0 because $R_f$ cannot be directly bonded to a N-atom of the carbodiimide group. There is at least one $R_f$ radical present in one or more of the $R^1$ and A groups for a given compound.

In the above general formula I, the divalent organic linking group A connects successive carbodiimide moieties when n is 1 or more. Illustrative linking groups A are alkylene groups, such as ethylene, isobutylene, hexylene, and methylenedicyclohexylene, having 2 to about 20 carbon atoms, aralkylene groups, such as $-CH_2C_6H_4CH_2-$ and $-C_6H_4CH_2C_6H_4-$, having up to 20 carbon atoms, arylene groups, such as tolylene, $-C_6H_3(CH_3)-$, poly(oxyalkylene) groups, such as $-(C_2H_4O)_yC_2H_4-$ where y is 1 to about 5, and various combinations of these groups. Such groups can also include other hetero moieties (besides —O—), including —S— and —N—. However, A is preferably free of groups with said active hydrogen atoms.

The A group can be a residue of an organic diisocyanate (from which the carbodiimido moiety can be derived, that is, A can be the divalent radical obtained by removal of the isocyanate groups from an organic diisocyanate. Suitable diisocyanate precursors may be simple, e.g. tolylene-2,4-diisocyanate, methylene bis(4-phenyleneisocyanate), and mixtures thereof, or complex, as formed by the reaction of a simple diisocyanate with an organic diol or polyol in appropriate proportions to yield an isocyanate-terminated polyurethane. Other isocyanates can also be used as starting materials. Some of these are described, for example, in U.S. Pat. No. 4,174,433. Representative A groups include $-CH_2C_6H_4CH_2C_6H_4CH_2-$, $-C_6H_3(CH_3)-$, $-C_6H_{10}CH_2C_6H_{10}-$, $-(CH_2)_6-$, $-C_6H_4CH_2C_6H_4-$, and $C_8F_{17}SO_2N[C_2H_4OCONHC_6H_3(CH_3)_2$. Although the fluorochemical carbodiimides used in this invention generally and preferably are derived from diisocyanates, the fluorochemical carbodiimides can be derived from triisocyanates, e.g. $OCNC_6H_4CH_2C_6H_3(NCO)CH_2C_6H_4NCO$. A mixture of di- and tri-isocyanates can be used to provide fluorochemical carbodiimides which are branched but still retain the desired solubility and dispersibility characteristics of the linear fluorochemical carbodiimides depicted by formula I.

The $R^1$—Q groups are preferably radicals derived from isocyanate compounds and can be aliphatic, e.g. $C_6H_{13}-$, aromatic, e.g. $C_6H_5-$, aralkyl, e.g. $C_6H_5CH_2-$, fluoroaliphatic, e.g. $C_6F_{13}CH_2-$, $C_7F_{15}CH_2OCONHC_6H_3(CH_3)-$, and $C_8F_{17}SO_2N(CH_3)C_2H_4OCONHC_6H_4CH_2C_6H_4-$. The organic $R^1$—Q radicals can have a variety of other structures, and can contain hetero atom-containing moieties, e.g. —O—, —S—, and $$-\overset{|}{N}-,$$

but, as with the A group, it is preferably free of groups containing said active hydrogen atoms.

The fluoroaliphatic radical, $R_f$, is a fluorinated, stable, inert, non-polar, preferably saturated, monovalent moiety which is both oleophobic and hydrophobic. It can be straight chain, branched chain, and, if sufficiently large, cyclic, or combinations thereof, such as alkylcycloaliphatic radicals. The skeletal chain can include catenary oxygen, hexavalent sulfur, and/or trivalent nitrogen hetero atoms bonded only to carbon atoms, such hetero atoms providing stable linkages between fluorocarbon portions of $R_f$ and not interferring with the inert character of the $R_f$ radical. While $R_f$ can have a large number of carbon atoms, compounds where $R_f$ is not more than 20 carbon atoms will be adequate and preferred since large radicals usually represent a less efficient utilization of fluorine than is possible with smaller $R_f$ radicals. The large radicals also are generally less soluble in organic solvents. Generally, $R_f$ will have 3 to 20 carbon atoms, preferably 6 to about 12, and will contain 40 to 78 weight percent, preferably 50 to 78 weight percent, fluorine. The terminal portion of the $R_f$ group has at least three fully fluorinated carbon atoms, e.g. $CF_3CF_2CF_2-$, and the preferred compounds are those in which the $R_f$ group is fully or substantially completely fluorinated, as in the case where $R_f$ is perfluoroalkyl, $C_nF_{2n+1}$.

The function of the linking group Q in formula I is to bond the $R^1$ groups to the N atoms of the carbodiimide units. Q can comprise a hetero atom-containing group or an organic group or a combination of such groups, examples of which are polyvalent aliphatic, e.g., $-CH_2-$, $-CH_2CH_2-$, and $-CH_2CH(CH_2-)_2$, polyvalent aromatic, oxy, thio, carbonyl, sulfone, sulfoxy, $-N(CH_3)-$, sulfonamido, carbonamido, sulfonamidoalkylene, carbonamidoalkylene, carbonyloxy, urethane, e.g., $-CH_2CH_2OCONH-$, and urea, e.g., —NHCONH—. The linkage Q for a specific fluorochemical carbodiimide useful in this invention will be dictated by the ease of preparation of such a compound and the availability of necessary precursors thereof. From the above description of Q, it is apparent that this linkage can have a wide variety of structures. However, as with the $R^1$ and A groups, Q is preferably free of moieties having said active hydrogen atoms.

The fluorochemical carbodiimides used in this invention are normally solid (i.e., solid at 20° C.) with melting points preferably in the range of 40° to 150° C. They are preferably soluble to the extent of at least 10 weight percent in ethyl acetate at 20° C.

Representative reaction schemes for the preparation of fluorochemical carbodiimides used in this invention are outlined below, where the products designated as I' are species of formula I supra.

Scheme 1

$$2R^1{-}Q'{-}OH + 2A(NCO)_2 \longrightarrow$$

$$2R^1{-}Q{-}NCO \xrightarrow[\text{cat., } -(n+1)CO_2]{+nA(NCO)_2}$$

$$R^1{-}Q(N{=}C{=}N{-}A)_nN{=}C{=}N{-}Q{-}R^1$$

I'

Scheme 2

$$(n+2)A(NCO)_2 \xrightarrow[-(n+1)CO_2]{\text{cat.}}$$

$$OCNA{-}(N{=}C{=}N{-}A)_nN{=}C{=}N{-}ANCO \xrightarrow{+2R^1{-}Q'{-}OH}$$

$$R^1{-}Q(N{=}C{=}N{-}A)_nN{=}C{=}N{-}Q{-}R^1$$

I'

Scheme 3

$$R{-}Q'{-}OH + A'(NCO)_3 \longrightarrow R{-}Q(NCO)_2$$

$$R{-}Q(NCO)_2 + A'(NCO)_3 + A(NCO)_2 +$$

$$R^1{-}QNCO \xrightarrow[-CO_2]{\text{cat.}} \text{Mixed carbodiimide}$$

The mixtures of fluorochemical carbodiimides used in this invention may contain small amounts of fluorochemical diurethane compounds (e.g., R—Q'—OCONH—A—NHCOO—Q'—R, a possible by-product in Scheme 1) free of carbodiimido groups due to the synthetic procedures generally followed. The amount of this by-product depends on the mode of addition, molar ratio of reactants, and the relative reactivity of isocyanate functional groups.

A preferred class of carbonylimino compounds for use in this invention can be represented by the formula:

$$A'[NHCOY(Q)_xR^2]_r \qquad \text{II}$$

where $R^2$ is a group like $R^1$ in formula I and at least one $R^2$ group is a fluoroaliphatic group ($R_f$), Q and x are as defined for formula I, r is an integer of 1 to 10, preferably 2 or 3, A' is an organic linking group having 2 to 20 carbon atoms, which is a residue of an organic isocyanate and is free of isocyanate-reactive groups, such as aliphatic hydroxy, and Y is $$-\overset{|}{N}-,\ -O-,\ \text{or}\ -S-.$$

Where there is a plurality of any $R^2$, Q, Y and x in a given compound, they can be the same or different.

The fluoroaliphatic radical-containing carbonylimino compounds preferably have at least one major transition temperature greater than 25° C., more preferably greater than that about 40° C., and most preferably greater than about 45° C. If desired, the compositions of the invention can contain mixtures of carbonylimino or imine compounds.

Carbonylimino compounds for use in this invention can be prepared by reacting organic isocyanates with fluoroaliphatic radical-containing compounds having an isocyanate-reactive hydrogen atom.

A preferred subclass of the carbonylimino compounds of formula II are those in which Y is —O—, viz., urethanes. Representative carbonylimino compounds of such preferred subclass are described in U.S. Pat. No. 3,484,281. They are prepared by conventional urethane bond-forming reactions between fluoroaliphatic alcohols and organic isocyanates, preferably aromatic polyisocyanates. If desired, fluorine-free aliphatic alcohols (e.g., fatty alcohols) can be incorporated into the reaction mixture used to form such carbonylimino compounds.

A representative reaction scheme for preparation of fluorochemical carbonylimino compounds used in this invention is outlined below.

Scheme 4

$$rR^2(Q)_xYH + A'(NCO)_r \rightarrow A'[NHCOY(Q)_xR^2]_r \qquad \text{II}$$

Fluorochemical esters which are useful as component (a) of the fluorochemical blends of this invention include those described in the aforementioned prior art publications.

A representative reaction scheme for the preparation of fluorochemical ester compounds used in this invention is outlined below.

$$aR^1{-}Q{-}OH + R(COOH)_a \xrightarrow[-H_2O]{\text{cat.}} R(COO{-}Q{-}R^1)_a$$

Representative $R_f$ intermediates for the preparation of fluorochemical carbodiimide, carbonylimino, or esters used in this invention include:

$C_8F_{17}SO_2N(C_2H_5)C_2H_4OH$
$C_8F_{17}C_2H_4OH$
$C_7F_{15}CH_2OH$
$C_7F_{15}CON(C_2H_5)C_2H_4OH$
$C_8F_{17}C_2H_4SC_2H_4OH$
$(CF_3)_2CF(CF_2)_8C_2H_4OH$
$(CF_3)_2CFOC_2F_4C_2H_4OH$
$C_8F_{17}C_2H_4SO_2N(CH_3)C_4H_8OH$
$C_8F_{17}SO_2N(CH_3)C_3H_6NH_2$

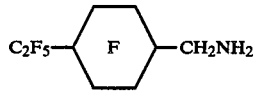

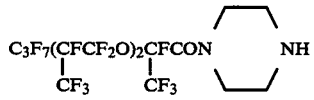

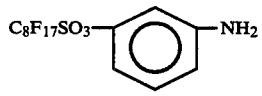

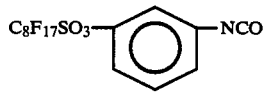

$C_8F_{17}C_6H_4NH_2$
$C_8F_{17}C_6H_4NCO$
$C_7F_{15}CH_2NCO$
$C_8F_{17}C_2H_4SH$

-continued $C_7F_{15}CON(CH_3)C_2H_4SH$

Representative organic isocyanates include:
tolylene-2,4-diisocyanate
hexamethylene diisocyanate
methylenebis(4-phenyleneisocyanate)
methylenebis(4-cyclohexyleneisocyanate)
xylylene diisocyanate
1-methoxy-2,4-phenylene diisocyanate
1-chlorophenyl-2,4-diisocyanate,
p-(1-isocyanotoethyl)phenyl isocyanate
phenyl isocyanate
m-tolyl isocyanate
2,5-dichlorophenyl isocyanate
hexyl isocyanate Representative carboxylic acids or anhydrides which can be used to prepare fluorochemical ester components by reaction with fluorochemical alcohols include adipic, citric, pyromellitic, and the like (such being disclosed in said U.S. Pat. Nos. 3,923,715 and 4,340,749).

Generally, the fluorochemical carbodiimide, carbonylimino compound, or esters will contain about 20 to 70 weight percent, preferably about 25 to 50 weight percent, of carbon-bonded fluorine. If the fluorine content is less than about 20 weight percent, impractically large amounts of the fluorochemical carbodiimide, carbonylimino compound, or esters will generally be required, while fluorine contents greater than about 70 weight percent are unnecessary to achieve the desired surface properties and thus represent an uneconomical use of fluorine and may also present compatibility problems where it is desired to apply the fluorochemical blend as an organic solution.

A class of fluorochemical oxyalkylene, component (b)—the other essential component of the blends of this invention—are fluoroaliphatic polymers (or oligomers, the term polymer hereinafter including oligomer unless otherwise indicated) represented by the general formulas:

$$(R_f)_sZ[(R^3)_yZ'B]_t \qquad \text{III}$$

$$[(R_f)_sZ[(R^3)_yZ'B']_t]_w \qquad \text{IV}$$

where $R_f$ is a fluoroaliphatic radical like that described for general formula I, Z is a linkage through which $R_f$ and $(R^3)_y$ moieties are covalently bonded together, $(R^3)_y$ is a poly(oxyalkylene) moiety, $R^3$ being an oxyalkylene group with 2 to 4 carbon atoms and y is an integer (where the above formulas are those of individual compounds) or a number (where the above formulas are those of mixtures) at least 5, generally 10 to 75 and can be as high as 100 or higher, B is a hydrogen atom or a monovalent terminal organic radical, B' is B or a valence bond, with the proviso that at least one B' is a valence bond interconnecting a Z-bonded $R^3$ radical to another Z, Z' is a linkage through which B, or B', and $R^3$ are covalently bonded together, s is an integer or number of at least 1 and can be as high as 25 or higher, t is an integer or number of at least 1, and can be as high as 60 or higher, and w is an integer or number greater than 1, and can be as high as 30 or higher.

In formulas III and IV, where there are a plurality of $R_f$ radicals, they are either the same or different. This also applies to a plurality of Z, Z', $R_3$, B, B', and, in formula IV, a plurality of s, y and t.

Generally, the oxyalkylene polymers will contain about 5 to 40 weight percent, preferably about 10 to 30 weight percent, of carbon-bonded fluorine. If the fluorine content is less than about 10 weight percent, impractically large amounts of the polymer will generally be required, while fluorine contents greater than about 35 weight percent result in polymers which have too low a solubility to be efficient.

In said poly(oxyalkylene) radical, $(R^3)_y$, $R^3$ is an oxyalkylene group having 2 to 4 carbon atoms, such as $$-OCH_2CH_2-,\ -OCH_2CH_2CH_2-,$$

$$-OCH(CH_3)CH_2-,\ \text{and}\ -OCH(CH_3)CH(CH_3)-,$$

the oxyalkylene units in said poly(oxyalkylene) being the same, as in poly(oxypropylene), or present as a mixture, as in a heteric straight or branched chain or randomly distributed oxyethylene and oxypropylene units or as in a straight or branched chain of blocks of oxyethylene units and blocks of oxypropylene units. The poly(oxyalkylene) chain can be interrupted by or include one or more catenary linkages. Where said catenary linkages have three or more valences, they provide a means for obtaining a branched chain or oxyalkylene units. The poly(oxyalkylene) radicals in the polymers can be the same or different, and they can be pendent. The molecular weight of the poly(oxyalkylene) radical can be as low as 220 but preferably is about 500 to 2500 and higher, e.g. 100,000 to 200,000 or higher.

The function of the linkages Z and Z' is to covalently bond the fluoroaliphatic radicals, $R_f$, the poly(oxyalkylene) moieties, $(R^3)_y$ and radicals B and B' together in the oligomer. Z and Z' can be a valence bond, for example, where a carbon atom of a fluoroaliphatic radical is bonded or linked directly to a carbon atom of the poly(oxyalkylene) moiety. Z and Z' each can also comprise one or more linking groups such as polyvalent aliphatic and polyvalent aromatic, oxy, thio, carbonyl, sulfone, sulfoxy, phosphoxy, amine, and combinations thereof, such as oxyalkylene, iminoalkylene, iminoarylene, sulfoamido, carbonamido, sulfonamidoalkylene, carbonamidoalkylene, urethane, urea, and ester. The linkages Z and Z' for a specific oxyalkylene polymer will be dictated by the ease of preparation of such an polymer and the availability of necessary precursors thereof.

From the above description of Z and Z' it is apparent that these linkages can have a wide variety of structures, and in fact where either is a valence bond, it doesn't even exist as a structure. However large Z or Z' is, the fluorine content (the locus of which is $R_f$) is in the aforementioned limits set forth in the above description, and in general the total Z and Z' content of the polymer is preferably less than 10 weight percent of the polymer.

The monovalent terminal organic radical, B, is one which is covalently bonded through Z', to the poly(oxyalkylene) radical.

Though the nature of B can vary, it preferably is such that it compliments the poly(oxyalkylene) moiety in maintaining or establishing the desired solubility of the oxyalkylene. The radical B can be a hydrogen atom, acyl, such as $C_6H_5C(O)$—, alkyl, preferably lower alkyl, such as methyl, hydroxyethyl, hydroxypropyl, mercaptoethyl and aminoethyl, or aryl, such as phenyl, chlorophenyl, methoxyphenyl, nonylphenyl, hydroxyphenyl, and aminophenyl. Generally, Z'B will be less than 50 weight percent of the $(R^3)_yZ'B$ moiety.

The fluoroaliphatic radical-containing oxyalkylene used in this invention can be prepared by a variety of known methods, such as by condensation, free radical, or ionic homopolymerization or copolymerization using solution, suspension, or bulk polymerization techniques, e.g., see "Preparative Methods of Polymer Chemistry," Sorenson and Campbell, 2nd ed., Interscience Publishers, (1968). Classes of representative oxyalkylenes useful in this invention include polyesters, polyurethanes, polyepoxides, polyamides and vinyl polymers such as polyacrylates and substituted polystyrenes.

The polyacrylates are a particularly useful class of oxyalkylenes and they can be prepared, for example, by free radical initiated copolymerization of a fluoroaliphatic radical-containing acrylate with a poly(oxyalkylene) acrylate, e.g. monoacrylate or diacrylate or mixtures thereof. As an example, a fluoroaliphatic acrylate, $R_f$—R''—$O_2C$—CH=$CH_2$ (where R'' is, for example, sulfonamidoalkylene, carbonamidoalkylene, or alkylene), e.g., $C_8F_{17}SO_2N(C_4H_9)CH_2CH_2O_2CCH{=}CH_2$, can be copolymerized with a poly(oxyalkylene)monoacrylate, $CH_2{=}CHC(O)(R^3)_xOCH_3$,, to produce a polyacrylate oxyalkylene.

Further description of fluorochemical oxyalkylenes useful in this invention will be omitted in the interest of brevity since such compounds and their preparation are known, said U.S. Pat. No. 3,787,351 and U.S. Pat. No. 4,289,892, both of which are incorporated herein for that purpose.

The amount of each component (a) and (b) can vary over a broad range, and will be selected to provide the desired balance of properties on the treated fiber of the finished article. Generally, component (a) will be the major amount of the blend and component (b) will be the minor amount. The particular amount depends on the particular composition of the textile fiber or article to be treated and the particular chemical composition of (a) and (b), as well as the application procedures used. Laboratory evaluation will often be a good indicator of appropriate relative amounts of components (a) and (b) to be used for obtaining the desired prformance in commercial application.

Generally, the relative amounts of components (a) and (b) fall within the following ranges:

| | Weight percent of fluorochemical solids in blend | | |
|---|---|---|---|
| Component | General Broad Range | Preferred Broad Range | Most Preferred Range |
| (a) | 40–99 | 60–99 | 70–95 |
| (b) | 1–60 | 1–40 | 5–30 |

The blends of this invention can be obtained by mixing (1) an organic solvent solution or aqueous dispersion of the fluorochemical component (a) with (2) the fluorochemical poly(oxyalkylene) which may be utilized in neat form or as an organic solvent solution or as an aqueous dispersion. If an aqueous emulsion is the desired form of the blend, the emulsification may be performed on the above organic solvent-containing blends, or individually emulsified components may be blended (by simple mixing techniques) as either solvent-containing or solvent-free emulsions. In the preparation of said emulsions it is generally beneficial to employ cationic fluorochemical surfactants (e.g., $C_8F_{17}SO_2N(H)C_3H_6N(CH_3)Cl$) along with hydrocarbon non-ionic surfactants (i.e., "Tween 80" polyoxyethylene sorbitan monooleate). Since the fluorochemical poly(oxyalkylenes) and mixtures thereof are themselves non-ionic surfactants, the hydrocarbon non-ionic co-surfactants may be totally or partially eliminated by the incorporation of the fluorochemical poly(oxyalkylene) into the solvent-containing blend prior to emulsification.

Substrates which can be treated in accordance with this invention are textile fibers (or filaments), and finished or fabricated fibrous articles such as textiles, e.g. carpet, paper, paperboard, leather, and the like. The textiles include those made from natural fibers, such as cotton and wool, and those made from synthetic organic fibers, such as nylon, polyolefin, acetate, rayon, acrylic, and polyester fibers. Especially good results are obtained on nylon and polyester fibers. The fibers or filaments as such or in an aggregated form, e.g. yarn, tow, web, or roving, or the fabricated textile, e.g., articles such as carpet and woven fabrics, can be treated with the fluorochemical blends. The treatment can be carried out by applying the fluorochemical blends as organic solutions or aqueous or organic dispersions by known techniques customarily used in applying fluorochemicals, e.g. fluorochemical acrylate copolymers, to fibers and fibrous substrates. (If desired, such known fluorochemicals can be used in conjunction with the above-described fluorochemical blends, such as fluoroaliphatic radical-containing polymers, e.g. acrylates and methacrylates). For example, the fluorochemical treatment can be by immersing the fibrous substrates in a bath containing the fluorochemical blend, padding the substrate or spraying the same with the fluorochemical blend, or by foam, kiss-roll, or metering applications, e.g. spin finishing, and then drying the treated substrates if solvent is present. If desired, the fluorochemical blend can be co-applied with conventional fiber treating agent (or adjuvants), e.g., antistatic agents or neat oils (non-aqueous fiber lubricants).

In the manufacture of synthetic organic fibers (see, for example, the review article in Kirk-Othmer, *Encyclopedia of Polymer Science and Technology,* 8, 374–404, 1968), the first step that normally takes place in the process, following initial formation of the filaments (e.g. by melt spinning or solvent spinning), is coating the fiber surface with a small amount (generally less than 2% active solids on fiber) of fiber finish comprising lubricating and antistatic agents. It is particularly advantageous to treat such textile fibers, e.g. nylon 6, with the fluorochemical blend of this invention in conjunction with the spin finish being applied to such textile fibers.

Fiber finishes are generally produced in the form of dilute aqueous emulsions or as an oil ("neat oil") which principally contains said lubricant and antistatic agent as well as emulsifier (surfactant) and may also contain materials such as bacteriocides and antioxidants.

Representative lubricants include mineral oils, waxes, vegetable oils (triglycerides) such as coconut oil, peanut oil, and castor oil, synthetic oils, such as esters, polyoxyethylene derivatives of alcohols and acids, and silicone oils.

The antistatic agents, emulsifiers, and surfactants incorporated into the fiber finish are selected from similar chemical classes, which include:

(a) anionics, such as fatty acid soaps, sulfated vegetable oils, salts of alkyl and ethoxylated alkyl phosphates;

(b) cationics, such as fatty amines, quaternary ammonium compounds, and quaternary phosphonium compounds;

(c) nonionics, such as glyceryl monooleate, ethoxylated alcohols, ethoxylated fatty acids, and ethoxylated fatty amides; and (d) amphoterics, such as betaines, amino acids and their salts.

The preferred mode of applying the fluorochemical blend of this invention to synthetic organic fibers is to incorporate the blend into the above-described fiber finishes in an amount sufficient to achieve the desired properties, oil and water repellency and soil resistance. Generally, the amount of fluorochemical blend to be used will be that sufficient to retain on the fiber of the finished article, e.g., carpet, about 200 to 1600 ppm fluorine based on the weight of the fiber. Such additions to the conventional fiber finish can be carried out without sacrificing or adversely affecting typical requirements that conventional fiber finishes must meet, namely lubrication, thermal stability, low fuming at elevated temperature, and wetting for fiber dyeability (color addition). The conventional finish components of the fiber finishes containing the fluorochemical blends of this invention can be removed in a conventional manner after the fiber is manufactured in fabric form, e.g., carpets and upholstery fabrics. The fluorochemical blends withstand the typical conditions encountered during fiber and yarn processing and also survive the more severe processing conditions which the greige goods encounter such as scouring and dyeing, and the finished goods encounter, such as washing, steam cleaning, and dry cleaning. The fluorochemical blends do not interfere with, and are durable through, the normal fiber processing steps, e.g., drawing, texturizing, and heat setting, and provide oil and water repellency and anti-soiling properties to the finished article, e.g., carpet made from the treated fibers.

The conventional application methods used to apply finishes to fibers (or filaments) can be used with the fluorochemical blend finishes of this invention. Such methods include the use of either (a) a revolving ceramic cylinder, i.e., kiss-roll, which is partially immersed in a pan containing the finish, over which the moving filaments pass and pick up a thin film of finish, (b) a metering pump supplying finish through a slot or hole in a fiber guide over which the moving filaments pass, (c) an immersion finish bath, or (d) spraying devices.

The fluorochemical blends of this invention are generally compatible with (i.e., dispersible or sufficiently soluble in) commercial neat oil fiber finishes, yielding stable dispersions or solutions thereof, and thus the blends may be mixed with such finishes and coapplied (or applied before or after them). Solubilizing aids, such as "Carbitol" or "Cellosolve" solvents, can be added to the finish to enhance solubility of the fluorochemical blends in the neat oil finish.

Representative fluorochemical carbodiimides useful as component (a) in the fluorochemical blends of this invention having the general formula V are shown in Table 1.

TABLE 1

$R—Q—A(N{=}C{=}N—A)_n—Q—R$ V

| Compound No.* | R—Q | A |
|---|---|---|
| 1 | $C_8F_{17}—SO_2N(C_2H_5)C_2H_4OCONH$ | $C_6H_4CH_2C_6H_4$ |
| 2 | $C_8F_{17}—SO_2N(C_2H_5)C_2H_4OCONH$ | $C_6H_3(CH_3)$ |
| 3 | $C_8F_{17}—SO_2N(C_4H_9)C_2H_4OCONH$ | $C_6H_4CH_2C_6H_4$ |
| 4 | $C_8F_{17}—C_2H_4OCONH$ | $C_6H_4CH_2C_6H_4$ |
| 5 | $C_8F_{17}—C_2H_4OCONH$ | $C_6H_3(CH_3)$ |

Representative fluorochemical oxyalkylenes useful as component (b) in the fluorochemical blends of this invention are shown in Table 2. Generally the preparation of the fluorochemical oxyalkylenes results in products which comprise mixtures of oxyalkylenes, the lengths of the fluoroaliphatic radical and the poly(oxyalkylene) moiety varying and the subscripts denoting the number of carbon atoms of the former and denoting the number of oxyalkylene units in a poly(oxyalkylene) segment being in both cases average numbers, and in this specification, e.g. Table 2, those subscripts should be understood as having such average values, unless otherwise indicated.

TABLE 2

1. $C_8F_{17}SO_2N(C_2H_5)CH_2CO_2(C_2H_4O)_{15}H$
2. $C_8F_{17}SO_2N(C_2H_5)C_2H_4O(C_2H_4O)_{14}H$
3. $C_8F_{17}C_2H_4O(C_2H_4O)_{15}H$
4. $C_8F_{17}SO_2N\begin{matrix}(C_2H_4O)_mH\\(C_2H_4O)_nH\end{matrix}$ (m + n = 25)
5. $C_8F_{17}SO_2N(C_2H_5)C_2H_4O(C_3H_6O)_8H$
6. $C_8F_{17}C_2H_4S\underset{\underset{CH_2CO_2(C_3H_6O)_nH}{|}}{CH}CO_2(C_3H_6O)_mH$ (m + n = 20)
7. $C_8F_{17}SO_2N(C_2H_5)C_2H_4O(C_2H_4O)_{7.5}H$ Representative fluorochemical oxyalkylene polyacrylates useful as component (b) in the blends of this invention are those made by copolymerizing any of the fluorochemical acrylates of Table 3 with any of the fluorine-free poly(oxyalkylene) monomers of Table 4.

TABLE 3

1. $C_8F_{17}SO_2N(CH_3)CH_2CH_2OOCCH{=}CH_2$,
2. $C_6F_{13}C_2H_4OOCC(CH_3){=}CH_2$,
3. $C_6F_{13}C_2H_4SC_2H_4OOCCH{=}CH_2$,
4. $C_8F_{17}C_2H_4OOCC(CH_3){=}CH_2$
5. $C_8F_{17}C_2H_4N(CH_3)C_2H_4OOCC(CH_3){=}CH_2$,
6. $C_2F_5C_6F_{10}CH_2OOCCH{=}CH_2$,
7. $C_7F_{15}CH_2OOCCH{=}CH_2$
8. $C_7F_{15}CON(CH_3)C_2H_4OOCCH{=}CH_2$,
9. $(CF_3)_2CF(CF_2)_6CH_2CH(OH)CH_2OOCCH{=}CH_2$,
10. $(CF_3)_2CFOC_2F_4C_2H_4OOCCH{=}CH_2$,
11. $C_8F_{17}C_2H_4SO_2N(C_3H_7)C_2H_4OOCCH{=}CH_2$,
12. $C_7F_{15}C_2H_4CONHC_4H_8OOCCH{=}CH_2$,
13. $C_3F_7(\underset{\underset{CF_3}{|}}{CF}CF_2O)_2\underset{\underset{CF_3}{|}}{CF}CH_2OOCCH{=}CH_2$,
14. $C_7F_{15}COOCH_2C(CH_3)_2CH_2OOCC(CH_3){=}CH_2$,
15. $C_8F_{17}SO_2N(C_2H_5)C_4H_8OOCCH{=}CH_2$,
16. $(C_3F_7)_2C_6H_3SO_2N(CH_3)C_2H_4OOCCH{=}CH_2$,
17. $C_2F_5CF\begin{matrix}CF_2CF_2\\CF_2CF_2\end{matrix}NC_2F_4CON(CH_3)C_2H_4OOCCH{=}CH_2$, TABLE 3-continued 18. $C_6F_{17}CF{=}CHCH_2N(CH_3)C_2H_4OOCCH{=}CH_2$,
19. $C_8F_{17}SO_2N(C_4H_9)C_2H_4OCOCH{=}CH_2$
20. $C_8F_{17}SO_2N(C_2H_5)C_2H_4OCOCH(CH_3){=}CH_2$

TABLE 4

1. $CH_2{=}CHCO_2(C_2H_4O)_{10}(C_3H_6O)_{22}(C_2H_4O)_9C_2H_4O_2CCH{=}CH_2$
2. $CH_2{=}CHCO_2(C_2H_4O)_{17}CH_3$
3. $CH_2{=}C(CH_3)CONH(C_3H_6O)_{44}H$
4. $CH_2{=}C(CH_3)CO_2(C_2H_4O)_{90}COC(CH_3){=}CH_2$
5. $HS(C_2H_4O)_{23}(C_3H_6O)_{35}(C_2H_4O)_{22}C_2H_4SH$

Specific fluorochemical oxyalkylene polymers are those of Table 5 described in terms of their monomers and the relative amounts thereof.

TABLE 5

| | Monomers | | |
|---|---|---|---|
| | Acrylate of Table 3 | Oxyalkylene of Table 4 | Weight Ratios, acrylate/oxyalkylene |
| 1 | 19 | 1 | 30/70 |
| 2 | 1 | 2 | 65/35 |
| 3 | 1 | 4 | 50/50 |
| 4 | 20 | 1 | 30/70 |

Other compatible optional comonomers, e.g. butyl acrylate, acrylonitrile, etc., which need not contain fluoroaliphatic radicals, can be copolymerized with the fluorochemical acrylate and oxyalkylene comonomers, in amounts up to about 25 weight percent, to improve compatibility or solubility of the fluorochemical oxyalkylene component (b) in the fiber finish.

Weight ratios of fluorochemical acrylate monomers (Table 3) and fluorochemical poly(oxyalkylene) monomers (Table 4) can vary but should be chosen along with said optional comonomers so that the carbon-bonded fluorine content of the resulting copolymer is in the desired range of 5 to 40 weight percent.

Representative fluorochemical urethane compounds useful in the practice of this invention as component (a) are those of Table 5A.

Table 5A

1. $[C_8F_{17}SO_2N(C_2H_5)C_2H_4OCONH]_2C_6H_3(CH_3)$
2. $ROCONHC_6H_4CH_2C_6H_3(NHCOOR)CH_2C_6H_4NHCOOR$ where two of the R groups are $C_8F_{17}SO_2N(C_2H_5)C_2H_4$— and one is $C_{18}H_{37}$—.

Objects and advantages of this invention are illustrated in the following examples.

EXAMPLE 1

In a 2-liter, 3-neck flask, fitted with a mechanical stirrer, condenser, thermometer, addition funnel and electric heating mantle, was placed 375 g (1.5 moles) methylenebis(4-phenyleneisocyanate) and 481 g methyl ethyl ketone (MEK). To this stirred heated solution (80°–83° C.) was added 554 g (1.0 mole) N-ethyl(perfluorooctane)sulfonamidoethyl alcohol over a 3 hour period and stirring and heating continued for an additional 3 hours.

To this stirred solution, containing fluorochemical urethane isocyanate and unreacted diisocyanate, was added 7.4 g camphene phenyl phosphine oxide, $C_{10}H_{16}POC_6H_5$, a carbodiimide-forming catalyst, and the reaction mixture was stirred and heated at about 80° C. for about 8 hours, at which time essentially all of the isocyanate groups had been converted to carbodiimide groups as indicated by IR absorption analysis.

The solid fluorochemical carbodiimide product is represented by compound no. 1 in Table 1.

EXAMPLES 2–5

Following the general procedure of Example 1, except employing the reagents in Table 6 and molar concentrations indicated in Table 7, the other fluorochemical carbodiimides of Table 1 were prepared. The reagents in Table 6 are identified by symbols, e.g. A-1, etc., for later reference.

TABLE 6

Alcohol Reagents

| | |
|---|---|
| A-1 | $C_8F_{17}SO_2N(C_2H_5)C_2H_4OH$ |
| A-2 | $C_8F_{17}SO_2N(C_4H_9)C_2H_4OH$ |
| A-3 | $C_8F_{17}C_2H_4OH$ |

Isocyanates

MDI

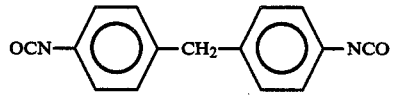

TDI

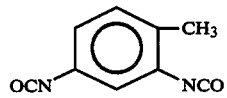

TABLE 7

| | Reactants (moles)** | |
|---|---|---|
| Ex. No.* | Alcohol Reagent | Isocyanate |
| 2 | A-1 (2) | TDI (2.8) |
| 3 | A-2 | MDI |
| 4 | A-3 | MDI |
| 5 | A-3 | TDI |

*The numbers correspond to the compound numbers of Table 1.
**All alcohol/isocyanate reagent molar ratios were ⅔, except as indicated for Example 2.

EXAMPLES 6–19

In each of these examples, a gold-colored, plush, cut-pile, pre-wet nylon carpet (50 oz/yd$^2$) was treated by top spray application (25% wet pickup) of a diluted mixture of an aqueous emulsion of the fluorochemical carbodiimide of compound no. 1 of Table 1 and an aqueous emulsion of a fluorochemical oxyalkylene, the dilution (with water) of the mixture of emulsions being done to obtain the desired concentration of fluorochemical components, (a) and (b), necessary to deposit the amounts (SOF) of fluorochemicals on the carpet specified in Table 8. The treated carpet samples were dried for 30 minutes at 70° C. and heated further at 130° C. for 10 min. For purposes of comparison, control examples (C-1 to C-9) were run in which the carpet treatment employed only one fluorochemical component (C-1 to C-8) or the example (C-9) did not include any treatment.

The oil repellency (OR), water repellency (WR) and walk-on soil resistance (WOS) were determined on the treated samples. The data is summarized in Table 8.

The water repellency test is one which is often used for this purpose. The aqueous stain or water repellency of treated samples is measured using a water/isopropyl alcohol test, and is expressed in terms of a water repellency rating of the treated carpet or fabric. Treated carpets which are penetrated by or resistant only to a 100 percent water/0 percent isopropyl alcohol mixture (the least penetrating of the test mixtures) are given a rating of 100/0, whereas treated fabrics resistant to a 0 percent water/100 percent isopropyl alcohol mixture (the most penetrating of the test mixtures) are given a rating of 0/100. Other intermediate values are determined by use of other water/isopropyl alcohol mixtures, in which the percentage amounts of water and isopropyl alcohol are each multiples of 10. The water repellency rating corresponds to the most penetrating mixture which does not penetrate or wet the fabric after 10 seconds contact. In general a water repellency rating of 90/10 or better, e.g., 80/20, is desirable for carpet.

The oil repellency test is also one which is often used for this purpose. The oil repellency of treated carpet and textile samples is measured by AATCC Standard Test 118–1978, which test is based on the resistance of treated fabric to penetration by oils of varying surface tensions. Treated fabrics resistant only to "Nujol", a brand of mineral oil and the least penetrating of the test oils, are given a rating of 1, whereas treated fabrics resistant to heptane (the most penetrating of the test oils) are given a value of 8. Other intermediate values are determined by use of other pure oils or mixtures of oils. The rated oil repellency corresponds to the most penetrating oil (or mixture of oils) which does not penetrate or wet the fabric after 10 seconds contact rather than the 30 seconds contact of the Standard Test. Higher numbers indicate better oil repellency. In general, an oil repellency of 2 or greater is desirable for carpet.

The soil resistance of treated and untreated (control) carpet was determined by exposure to pedestrian traffic according to AATCC Test method 122–1979, the exposure site being a heavily travelled industrial area for an exposure of about 15,000 "traffics". The samples are repositioned periodically to insure uniform exposure and are vacuumed every 24 hours during the test and before visual evaluation. The evaluation employed the following "Walk-On-Soiling" (WOS) rating system:

| WOS Rating | Description |
|---|---|
| 0 | equal to control |
| ±½ | slightly better (+) or worse (−) than control |
| ±1 | impressive difference compared to control |
| ±1½ | very impressive difference compared to control |
| ±2 | extremely impressive difference compared to control |

In the tables which follow, the fluorochemical poly(oxyalkylene) used is identified according to the following code:

TABLE 8

| Ex. No. | Fluorochemical Carbodiimide % SOF[a] | Fluorochemical Polyoxyalkylene Code | Fluorochemical Polyoxyalkylene % SOF | OR | WR | WOS |
|---|---|---|---|---|---|---|
| 6 | .09 | A | .01 | 1.5 | 70/30 | −½ to −1 |
| 7 | .05 | A | .05 | 1.5 | 70/30 | +1 |
| 8 | .09 | B | .01 | 1 | 70/30 | +½ to 0 |
| 9 | .05 | B | .05 | 2 | 60/40 | 0 |
| 10 | .09 | C | .01 | 2 | 70/30 | 0 |
| 11 | .05 | C | .05 | 2.5 | 70/30 | 0 |
| 12 | .09 | D | .01 | 2 | 60/40 | −½ |
| 13 | .05 | D | .05 | 2 | 70/30 | 0 |
| 14 | .09 | E | .01 | 1.5 | 70/30 | 0 |
| 15 | .05 | E | .05 | 1.5 | 70/30 | 0 to +½ |
| 16 | .09 | F | .01 | 1.5 | 70/30 | −½ |
| 17 | .05 | F | .05 | 3.5 | 50/50 | −2 |
| 18 | .09 | G | .09 | 1.5 | 70/30 | 0 to +½ |
| 19 | .05 | G | .05 | 1.5 | 70/30 | 0 to +½ |
| C-1 | none | A | .10 | 2 | 50/50 | −1½ |
| C-2 | none | B | .10 | 2.5 | 70/30 | −½ |
| C-3 | none | G | .10 | 0 | NWR[c] | −2 |
| C-4 | none | H | .10 | 0 | NWR | −1½ |
| C-5 | none | E | .10 | 0 | NWR | −2 |
| C-6 | none | F | .10 | 4.5 | NWR | −2 |
| C-7 | none | D | .10 | 0 | NWR | −1½ |
| C-8 | .10 | none | none | 2 | 70/30 | 0 |
| C-9 | none | none | none | 0 | NWR | −2 |

[a]% SOF means % fluorochemical solids on fabric.
[b]WOS means walk-on soil value is with respect to carpet treated with fluorochemical carbodiimide only (Ex. No. C-8, WOS = 0)
[c]NWR means no water resistance The data of Table 8 show that useful oil and water repellency was obtained from all of the blends (Examples 6–19) and that the soil resistance of most of the blend examples were better than or equal to that of the comparative example. Those properties obtained for Examples 6–19 as compared to the Examples C-1 thru C-7, are particularly noteworthy.

The control Example C-8, which was carpet treated only with fluorochemical carbodiimide, had a particularly harsh hand. However, where the blends were used (Ex. No. 6–19), the hand of the treated carpets was soft, which was considered to be equal to the untreated carpet, especially at the higher concentration of the fluorochemical oxyalkylene component.

EXAMPLES 20–22

These examples describe the treatment of nylon carpet fiber with aqueous emulsions of component (a) fluorochemical carbodiimide of compound no. 1 in Table 1 and component (b) various fluorochemical oxyalkylene blends of this invention in combination with an aqueous emulsion of a coconut oil based spin finish lubricant, and the results of testing of the dyed carpet prepared from the treated fibers.

A 65/35 copolymer of $C_8F_{17}SO_2N(CH_3)CH_2CH_2OOCCH{=}CH_2$ and $CH_2{=}CHCO_2(C_2H_4O)_{17}CH_3$ B 50/40/10 copolymer of $C_8F_{17}SO_2N(CH_3)CH_2CH_2OOCCH{=}CH_2$, $CH_2{=}C(CH_3)CO_2(C_2H_4O)_{90}H$, and $CH_2{=}C(CH_3)CO_2(C_2H_4O)_{90}COC(CH_3){=}CH_2$

C $C_8F_{17}SO_2N(C_2H_5)C_2H_4O(C_2H_4O)_{14}H$

D $C_8F_{17}SO_2N(C_2H_5)C_2H_4O(C_2H_4O)_{7.5}H$

E 30/40/30 copolymer of $C_8F_{17}SO_2N(C_4H_9)C_2H_4OCOCH{=}CH_2$, $CH_2{=}CHCO_2(C_2H_4O)_{10}(C_3H_6O)_{22}(C_2H_4O)_9C_2H_4OH$, and $CH_2{=}CHCO_2(C_2H_4O)_{10}(C_3H_6O)_{22}(C_2H_4O)_9C_2H_4O_2CCH{=}CH_2$ F 30/40/30 copolymer of $C_8F_{17}SO_2N(C_2H_5)C_2H_4OCOCH(CH_3){=}CH_2$, $CH_2{=}CHCO_2(C_2H_4O)_{10}(C_3H_6O)_{22}(C_2H_4O)_9C_2H_4OH$, and $CH_2{=}CHCO_2(C_2H_4O)_{10}(C_3H_6O)_{22}(C_2H_4O)_9C_2H_4O_2CCH{=}CH_2$

G $C_8F_{17}SO_2N(C_2H_5)C_2H_4O(C_3H_6O)_8H$

H $C_8F_{17}C_2H_4SCHCO_2(C_3H_6O)_mH$
$\quad\quad\quad

The composition of the applied finish for these examples had fluorochemical solids to spin finish lubricant solids ratio in the range of 0.18:1 to 0.14:1.

The spin finish emulsion composition was applied by a metered slot applicator to melt extruded, undrawn yarn of nylon 6 fibers. The yarn was made up of 118 filaments of 18 denier (per filament). The resultant fiber immediately after application had from 1.0 to 1.5 weight percent of the lubricant component on the fibers. The treated yarn was continuously drawn and texturized and made into level-loop carpet (28 oz/yd$^2$), heat set at 196° C. for one minute, acid dyed, dried at 70° C. for 30 min., heated at 130° C. for 10 min., and then evaluated for oil and water repellency, walk-on soil resistance, and retention of fluorochemical treatment through the dyeing process as determined by fluorine analysis. The testing results are shown in Table 9. Comparison exmples, C-10, C-11, were run, one of them omitting any fluorochemical treatment, and the other including a treatment with only one fluorochemical component, viz., the carbodiimide of compound no. 1 of Table 1.

TABLE 9

| Ex. No. | Relative amts., (in terms of wt % fluorine) of Fluorochemical components (a)/(b)* | Amount of Fluorine on carpet: Before dyeing, ppm | After dyeing, ppm | % Retention of Fluorochemical | OR | WR | WOS |
|---|---|---|---|---|---|---|---|
| 20 | 80/20 | 683 | 619 | 91 | 3 | 40/60 | +1 |
| 21 | 80/20 | 784 | 673 | 86 | 5 | 20/80 | +½ |
| 22 | 70/30 | 607 | 570 | 94 | 5 | 10/90 | 0 |
| C-10 | 100/0 | 709 | 545 | 77 | 3 | 40/60 | 0 |
| C-11 | none | 0 | 0 | 0 | 0 | NWR | −2 |

*The fluorochemical oxyalkylenes used in Ex. Nos. 20, 21, 22 were copolymers E, B, and A, respectively.

The data of Table 9 show that improved oil and water repellency was obtained from most of the above blends (Ex. Nos. 20, 21, 22) and that the soil resistance was generally better than the control (C-10). Particularly noteworthy are the higher retention values of the blends as compared to the control C-10.

EXAMPLES 23–26

In these examples, two different rainwear fabrics were treated with an aqueous emulsion of a blend of (a) the fluorochemical carbodiimide of compound no. 1 of Table 1 and (b) a fluorochemical oxyalkylene in a padding operation, dried at 150° C. for 10 minutes, and evaluated for initial oil repellency (OR) and resistance to a water spray (SR), then these properties evaluated again after 5 launderings (5L) and also after one dry cleaning (DC).

The OR test used was the above-described AATCC Standard Test 118-1978, the contact time before observation being the specified 30 sec., an OR value of 3 or greater being particularly desirable for rainwear fabrics.

The water spray rating (SR) is measured by AATCC Test Method 22-1979. The spray rating is measured using a 0 to 100 scale where 100 is the highest possible rating. In general, a spray rating of 70 or greater is desirable, particularly for outerwear fabrics.

The treated fabrics were laundered using a mechanically agitated automatic washing machine capable of containing a 4 Kg. load, using water at 50° C. and a commercial detergent, and then the washed fabrics were tumble-dried in an automatic dryer for 40 minutes at 70° C. and pressed in a flat-bed press (at 154° C.) before testing.

The treated fabrics were dry cleaned using perchloroethylene containing 1% of a dry cleaning detergent and tumbling in a motor driven tumble jar (AATCC Test) Method 70-1975) for 20 minutes at 25° C. After removing excess solvent in a wringer, samples were dried at 70, C. for 10 minutes, then pressed on each side for 15 seconds on a flat-bed press maintained at 154° C.

The data are summarized in Table 10 together with comparison examples C-12 through C-19.

TABLE 10

| Ex. No. | Relative amts. (in terms of wt % fluorine) of fluorochemical components (a)/(b)* | Total % SOF | Fabric** | Initial OR | Initial SR | 5L OR | 5L SR | DC OR | DC SR |
|---|---|---|---|---|---|---|---|---|---|
| 23 | 98/2 | 0.21 | A | 6 | 80 | 5 | 80 | 2.5 | 70 |
| 24 | 98/2 | 0.21 | B | 6 | 80 | 3 | 70 | 4 | 80 |
| 25 | 80/20 | 0.2 | A | 6 | 70 | 5.5 | 70 | 6 | 70 |
| 26 | 80/20 | 0.2 | B | 6 | 80 | 5 | 75 | 6 | 80 |
| C-12 | 100/0 | 0.2 | A | 5 | 70 | 5 | 70 | 3 | 70 |
| C-13 | 100/0 | 0.2 | B | 5.5 | 80 | 5 | 80 | 4.5 | 80 |
| C-14 | 0/100 | 0.2 | A | 0 | 0 | 0 | 0 | 0 | 0 |
| C-15 | 0/100 | 0.2 | B | 0 | 0 | 0 | 0 | 0 | 0 |
| C-16 | 0/100 | 0.2 | A | 6.5 | 50 | 0 | 0 | 6 | 70 |
| C-17 | 0/100 | 0.2 | B | 5 | 70 | 1 | 70 | 6 | 70 |
| C-18 | 0/100 | none | A | 0 | 0 | 0 | 0 | 0 | 0 |
| C-19 | — | none | B | 0 | 0 | 0 | 0 | 0 | 0 |

*The fluorochemical oxyalkylene used in Ex. No. 23, 24 and C-14, C-15 was copolymer E and that used in Ex. No. 25, 26 and C-16, C-17 was copolymer B.
**Fabric A is 100% nylon taffeta; Fabric B is 100% woven polyester.

The data of Table 10 show that improved OR, SR, and durability to laundering and dry cleaning properties were obtained with most of the blends as compared to either component alone.

EXAMPLES 27–40

In the following examples, aqueous emulsion blends of the fluorochemical urethane 1 of Table 5A and several different fluorochemical oxyalkylenes were used to treat nylon carpet, following the procedure of Ex. 6–19. The dried samples were evaluated for OR, WR and WOS. The results are summarized in Table 11.

TABLE 11

| Ex. No. | Fluorochemical Urethane % SOF | Fluorochemical Oxyalkylene Code | Fluorochemical Oxyalkylene % SOF | OR | WR | WOS |
|---|---|---|---|---|---|---|
| 27 | .09 | A | .01 | 2 | 70/30 | −½ |
| 28 | .05 | A | .05 | 2.5 | 80/20 | −½ to 0 |
| 29 | .09 | B | .01 | 2 | 70/30 | −½ to 0 |
| 30 | .05 | B | .05 | 2 | 70/30 | +½ |
| 31 | .09 | C | .01 | 2 | 70/30 | +½ |
| 32 | .05 | C | .05 | 3 | 70/30 | 0 to +½ |
| 33 | .09 | D | .01 | 2 | 70/30 | −½ |
| 34 | .05 | D | .05 | 4 | 90/10 | 0 to +½ |
| 35 | .09 | E | .01 | 1.5 | 70/30 | 0 to +½ |
| 36 | .05 | E | .05 | 2 | NWR | −1 |
| 37 | .09 | F | .01 | 2.5 | 70/30 | −½ |
| 38 | .05 | F | .05 | 4.5 | NWR | −1 |
| 39 | .09 | G | .01 | 2.5 | 70/30 | 0 to +½ |
| 40 | .05 | G | .05 | 3 | 70/30 | 0 to +½ |
| C-20 | .10 | none | none | 3 | 70/30 | 0 |
| C-21 | None | none | none | 0 | NWR | −2 |

The data of Table 11 show that all of the blend examples have better OR and WOS than the untreated carpet, C-21, and most of the blend examples had better WR than the untreated carpet (C-21). Also, all of the blend examples had better WOS than the controls C-1 to C-7 which used only the fluorochemical oxyalkylene component. It is particularly noteworthy that half of the blend examples had better WOS than the control Example C-20 where the urethane fluorochemical component was used alone.

EXAMPLES 41, 42

Following the procedure of previous Examples 23–26, two rainwear fabrics were treated with an aqueous emulsion of a blend of (a) the fluorochemical urethane 2 of Table 5A and (b) the fluorochemical oxyalkylene B in a padding operation, dried at 150° C. for 10 minutes, and evaluated for initial OR and SR, then these properties evaluated again after 5L and also after one DC. The results are given in Table 12.

TABLE 12

| Ex. No. | Relative amts. (in terms of wt % fluorine) of fluorochemicals components (a)/(b) | Total % SOF | Fabric* | Initial OR | Initial SR | 5L OR | 5L SR | DC OR | DC SR |
|---|---|---|---|---|---|---|---|---|---|
| 41 | 80/20 | 0.2 | A | 6.5 | 70 | 6 | 75 | 5 | 70 |
| 42 | 80/20 | 0.2 | B | 6 | 70 | 5.5 | 70 | 6 | 70 |
| C-22 | 100/0 | 0.2 | A | 6 | 80 | 5.5 | 80 | 1 | 50 |
| C-23 | 100/0 | 0.2 | B | 6 | 70 | 5 | 70 | 2 | 0 |

*Fabric A was nylon taffeta, and fabric B was woven polyester

The data of Table 12 show that the initial and 5L oil repellency obtained with the blends (Ex. No. 41, 42) were better than results obtained with the fluorochemical urethane alone (Ex. C-22, C-23). The durabilty to dry-cleaning obtained by use of the blend (Ex. No. 41, 42) is particularly noteworthy when compared to Examples C-22, C-23, using the fluorochemical urethane alone.

Various modifications and alterations of this invention will become apparent to those skilled in the art without departing from the scope of this invention.

What is claimed is:

1. A composition comprising a blend of: (a) a normally solid, water-insoluble, fluorochemical composition which is a fluoroaliphatic radical-containing compound, or composition comprising a mixture of such compounds, said compound having one or more monovalent fluoroaliphatic radicals, having at least three fully fluorinated carbon atoms, and one or more polar moieties selected from carbodiimido, carbonylimino, ester moieties, and combinations thereof, said radicals and moieties being bonded together by linking groups selected from aliphatic, aromatic, oxy, thio, carbonyl, sulfone, sulfoxy, —N(CH$_3$)—, sulfonamido, carbonamido, sulfonamidoalkylene, carbonamidoalkylene, carbonyloxy, urethane, urea, and combinations thereof; and (b) a normally liquid or low melting solid, water soluble or dispersible, fluoroaliphatic radical-containing poly(oxyalkylene), or composition comprising a mixture of such poly(oxyalkylenes), said poly(oxyalkylene) having one or more of said fluoroaliphatic radicals and one or more poly(oxyalkylene) moieties, said radicals and poly(oxyalkylene) moieties bonded together by linking groups selected from aliphatic, aromatic, oxy, thio, carbonyl, sulfone, sulfoxy, phosphoxy, amine, oxyalkylene, iminoalkylene, iminoarylene, sulfoamido, carbonamido, sulfonamidoalkylene, carbonamidoalkylene, urethane, urea, ester, and combinations thereof.

2. A composition according to claim 1 wherein said fluorochemical composition (a) is a fluoroaliphatic radical-containing carbodiimide or carbonylimino compound.

3. A composition comprising a blend of:

(a) a normally solid, water-insoluble, fluorochemical composition which is a fluoroaliphatic radical-containing compound, or composition comprising a mixture of such compounds, said fluorochemical composition being represented by the general formula $$R^1—Q—_x—N{=}C{=}N—A)_n—N{=}C{=}N—Q)_xR^1$$

wherein n is 0 to 20, x is 0 or 1, A is a divalent organic linking group selected from alkylene, aralkylene, arylene, and combinations thereof which can contain a hetero moiety and a fluoroaliphatic radical $R_f$, having at least three fully fluorinated carbon atoms, $R_1$ is a hydrogen atom, said $R_f$, or an organic radical selected from alkyl, cycloalkyl, aryl, and combinations thereof which can contain hetero moieties, Q is a linking group selected from aliphatic, aromatic, oxy, thio, carbonyl, sulfone, sulfoxy, —N(CH$_3$)—, sulfonamido, carbonamido, sulfonamidoalkylene, carbonamidoalkylene, carbonyloxy, urethane, urea, and combinations thereof, with the proviso that at least one $R_f$ be present in one or more of $R^1$ and A; and (b) a normally liquid or low melting solid, water soluble or dispersible, fluoroaliphatic radical-containing poly(oxyalkylene), or composition comprising a mixture of such poly(oxyalkylenes), said poly(oxyalkylene) having one or more of said fluoroaliphatic radicals and one or more poly(oxyalkylene) moieties, said radicals and poly(oxyalkylene) moieties bonded together by linking groups selected from aliphatic, aromatic, oxy, thio, carbonyl, sulfone, sulfoxy, phosphoxy, amine, oxyalkylene, iminoalkylene, iminoarylene, sulfonamido, carbonamido, sulfonamido alkylene, carbonamidoalkylene, urethane, urea, ester, and combinations thereof.

4. A composition comprising a blend of:

(a) a normally solid, water-insoluble, fluorochemical composition which is a fluoroaliphatic radical-containing compound, or composition comprising a mixture of such compounds, said fluorochemical composition being represented by the formula $$R—Q—A(N{=}C{=}N—A)_n—Q—R$$

where R—Q is $C_8F_{17}SO_2N(C_2H_5)C_2H_4OCONH$—, A is —$C_6H_4CH_2C_6H_4$—, and n is 2; and (b) a normally liquid or low melting solid, water soluble or dispersible, fluoroaliphatic radical-containing poly(oxyalkylene), or composition comprising a mixture of such poly(oxyalkylenes), said poly(oxyalkylene) having one or more of said fluoroaliphatic radicals and one or more poly(oxyalkylene) moieties, said radicals and poly(oxyalkylene) moieties bonded together by linking groups selected from aliphatic, aromatic, oxy, thio, carbonyl, sulfone, sulfoxy, phosphoxy, amine, oxyalkylene, iminoalkylene, iminoarylene, sulfoamido, carbonamido, sulfonamidoalkylene, carbonamidoalkylene, urethane, urea, ester, and combinations thereof.

5. A composition according to claim 1 wherein said fluorochemical composition (a) is represented by the formula $$A'[NHCOY(Q)_xR^2]_r$$

where A' is a residue of an organic isocyanate,

Y is —$\overset{|}{N}$—, —O—, OR —S—, , or —S—,

Q is a linking group selected from aliphatic, aromatic, oxy, thio, carbonyl, sulfone, sulfoxy, —$N(CH_3)$—, sulfonamido, carbonamido, sulfonamidoalkylene, carbonamidoalkylene, carbonyloxy, urethane, urea, and combinations thereof, $R^2$ is a hydrogen atom, a fluoroaliphatic group having at least three fully fluorinated carbon atoms, or an organic radical selected from alkyl, cycloalkyl, aryl, and combinations thereof which can contain hetero moieties, at least one $R^2$ being said fluoroaliphatic radical, x is 0 or 1, and r is an integer of 1 to 10.

6. A composition according to claim 1 wherein said fluoroaliphatic radical-containing poly(oxyalkylene) has the general formula $$(R_f)_sZ[(R^3)_yZ'B]_t \text{ or } [(R_f)_sZ[(R^3)_yZ'B']_t]_w$$

where $R_f$ is said fluoroaliphatic radical,

Z is a linkage selected from aliphatic, aromatic, oxy, thio, carbonyl, sulfone, sulfoxy, phosphoxy, amine, oxyalkylene, iminoalkylene, iminoarylene, sulfoamido, carbonamido, sulfonamidoalkylene, carbonamidoalkylene, urethane, urea, ester, and combinations thereof through which $R_f$ and $(R^3)_y$ are covalently bonded together, $(R^3)_y$ is a poly(oxyalkylene) moiety, $R^3$ being oxyalkylene with 2 to 4 carbon atoms, and y is an integer or number of at least 5 and can be as high as 100 or higher, B is hydrogen or a monovalent terminal organic radical selected from acyl, alkyl, and aryl, B' is B or a valence bond, with the proviso that at least one B' is a valence bond interconnecting a Z-bonded $(R^3)_y$ radical to another Z, Z' is a linkage selected from aliphatic, aromatic, oxy, thio, carbonyl, sulfone, sulfoxy, phosphoxy, amine, oxyalkylene, iminoalkylene, iminoarylene, sulfoamido, carbonamido, sulfonamidoalkylene, carbonamidoalkylene, urethane, urea, ester, and combinations thereof through which B or B' and $(R^3)_y$ are covalently bonded together, s is an integer or number of at least 1 and can be as high as 25 or higher, t is an integer or number of at least 1 and can be as high as 60 or higher, and w is an integer or number greater than 1 and can be as high as 30 or higher.

7. A composition according to claim 1 wherein said fluorochemical poly(oxyalkylene) is the copolymer of $C_8F_{17}SO_2N(CH_3)C_2H_4O_2CCH{=}CH_2$ and $CH_2{=}C(CH_3)CO_2(C_2H_4O)_{90}COC(CH_3){=}CH_2$.

8. A composition comprising a blend of:

(a) a normally solid, water-insoluble, fluorochemical composition which is a fluoroaliphatic radical-containing compound, or composition comprising a mixture of such compounds, said fluorochemical composition being represented by the formula $$R—Q—A(N{=}C{=}N—A)_n—Q—R$$

where R—Q is $C_8F_{17}SO_2N(C_2H_5)C_2H_4OCONH$—, A is —$C_6H_4CH_2C_6H_4$—, n is 2; and (b) a normally liquid or low melting solid, water soluble or dispersible, fluoroaliphatic radical-containing poly(oxyalkylene), or composition comprising a mixture of such poly(oxyalkylenes), said poly(oxyalkylene) being the copolymer of $C_8F_{17}SO_2N(CH_3)C_2H_4O_2CCH{=}CH_2$ and $CH_2{=}C(CH_3)CO_2(C_2H_4O)_{90}COC(CH_3){=}CH_2$.

9. A composition comprising a blend of:

(a) a normally solid, water-insoluble, fluorochemical composition which is a fluoroaliphatic radical-containing compound, or composition comprising a mixture of such compounds, said fluorochemical composition being represented by the formula $$R—Q—A(N{=}C{=}N—A)_n—Q—R$$

where R—Q is $C_8F_{17}SO_2N(C_2H_5)C_2H_4OCONH$—, A is —$C_6H_4CH_2C_6H_4$—, n is 2; and (b) a normally liquid or low melting solid, water soluble or dispersible, fluoroaliphatic radical-containing poly(oxyalkylene), or composition comprising a mixture of such poly(oxyalkylenes), said poly(oxyalkylene) being the copolymer of $C_8F_{17}SO_2N(CH_3)C_2H_4O_2CCH{=}CH_2$, $CH_2{=}C(CH_3)CO_2(C_2H_4O)_{90}COC(CH_3){=}CH_2$, and $CH_2{=}C(CH_3)CO_2(C_2H_4O)_{90}H$.

10. A fiber finish comprising an organic solution or aqueous dispersion comprising a blend of: (a) a normally solid, water-insoluble, fluorochemical composition which is a fluoroaliphatic radical-containing compound, or composition comprising a mixture of such compounds, said compound having one or more monovalent fluoroaliphatic radicals, having at least three fully fluorinated carbon atoms, and one or more polar moieties selected from carbodiimido, carbonylimino, ester moieties, and combinations thereof, said radicals and moieties being bonded together by linking groups selected from aliphatic, aromatic, oxy, thio, carbonyl, sulfone, sulfoxy, —$N(CH_3)$—, sulfonamido, carbonamido, sulfonamido-alkylene, carbonamidoalkylene, carbonyloxy, urethane, urea, and combinations thereof; and (b) a normally liquid or low melting solid, water soluble or dispersible, fluoroaliphatic radical-containing poly(oxyalkylene), or composition comprising a mixture of such poly(oxyalkylenes), said poly(oxyalkylene) having one or more of said fluoroaliphatic radicals and one or more poly(oxyalkylene) moieties, said radicals and poly(oxyalkylene) moieties bonded together by linking groups selected from aliphatic, aromatic, oxy, thio, carbonyl, sulfone, sulfoxy, phosphoxy, amine, oxyalkylene, iminoalkylene, iminoarylene, sulfoamido, carbonamido, sulfonamidoalkylene, carbonamidoalkylene, urethane, urea, ester, and combinations thereof.

11. The fiber finish according to claim 10 wherein said fluorochemical composition (a) is a fluoroaliphatic radical-containing carbodiimide, ester or carbonylimino compound.

12. The fiber finish according to claim 10 further comprising a fiber lubricant.

13. A method for imparting oil and water repellency to a fibrous substrate, which comprises treating the surface thereof with the fiber finish of claim 12.

14. In the manufacture of spun synthetic organic fibers wherein a fiber finish is applied to said fibers, the improvement comprising employing as said fiber finish the fiber finish of claim 12.

15. A fibrous substrate coated with the fluorochemical blend composition of claim 1.

16. A fibrous substrate according to claim 15 wherein said substrate is nylon carpet fiber.

17. A composition according to claim 1 wherein said fluorochemical poly(oxyalkylene) is the copolymer of $C_8F_{17}SO_2N(CH_3)C_2H_4O_2CCH{=}CH_2$, $CH_2{=}C(CH_3)CO_2(C_2H_4O)_{90}H$, and $CH_2{=}C(CH_3)CO_2(C_2H_4O)_{90}COC(CH_3){=}CH_2$.

* * * * *

UNITED STATES PATENT AND TRADEMARK OFFICE

CERTIFICATE OF CORRECTION

PATENT NO. : 4,560,487

DATED : December 24, 1985

INVENTOR(S) : Robert W. Brinkley

It is certified that error appears in the above-identified patent and that said Letters Patent is hereby corrected as shown below:

Col. 2, line 60, "$R^1$-Q-$_x$-N=C=N=A-$_n$N=C=N-Q-$_x$$R^1$" should read --$R^1${Q}$_x${N=C=N-A}$_n$N=C=N{Q}$_x$$R^1$--.

Col. 3, line 22, "or" should read --of--.

Col. 7, line 12, "p-(1-isocyanotoethyl)" should read --p-(1-isocyanatoethyl)--.

Col. 9, line 47, "prformance" should read --performance--.

Col. 10, line 44, "agent" should read --agents--.

Col. 12, line 2, "R-Q-A(N=C=N-A)$_n$-Q-R" should be inserted before TABLE 1.

Col. 12, line 10, footnote omitted, insert --*For all compounds listed, n has an average value of 2, except for compound no. 2, where n has a value of about 1.8.--

Col. 17, line 17, "exmples" should read --examples--.

UNITED STATES PATENT AND TRADEMARK OFFICE

CERTIFICATE OF CORRECTION

PATENT NO. : 4,560,487

DATED : December 24, 1985

INVENTOR(S) : Robert W. Brinkley

It is certified that error appears in the above-identified patent and that said Letters Patent is hereby corrected as shown below:

Col. 18, line 38, "Test)", delete close parenthesis.

Col. 20, line 42, "$R^1$-Q-$_x$N=C=N=A)$_n$-N=C=N-Q)$_x$$R^1$" should read --$R^1${Q}$_x${N=C=N-A}$_n$-N=C=N{Q}$_x$$R^1$.--

Signed and Sealed this

Twenty-fourth Day of June 1986

[SEAL]

Attest:

DONALD J. QUIGG

Attesting Officer

Commissioner of Patents and Trademarks